US005345634A

United States Patent [19]

Sokol

[11] Patent Number: 5,345,634

[45] Date of Patent: Sep. 13, 1994

[54] APPARATUS FOR TREATING AND PREVENTING DEVELOPMENT OF BED SORES

[75] Inventor: Edward W. Sokol, Warren, Mich.

[73] Assignee: Rosalie M. Anderson, Mt. Clemens, Mich.

[21] Appl. No.: 89,040

[22] Filed: Jul. 9, 1993

[51] Int. Cl.[5] ..... A47C 21/00

[52] U.S. Cl. ..... 5/658; 5/425; 5/937; 128/889

[58] Field of Search ..... 5/658, 425, 503.1, 662, 5/663, 937, 498; 128/870, 871, 889

[56] References Cited

U.S. PATENT DOCUMENTS

| | | | |
|---|---|---|---|
| 1,044,592 | 11/1912 | Stott | 5/498 |
| 1,215,403 | 2/1917 | Parker | 5/503.1 |
| 1,491,160 | 4/1924 | Meunier | 5/498 |
| 3,029,447 | 4/1962 | Maertins | 5/662 |
| 3,143,747 | 8/1964 | McSorley | 5/498 |
| 3,221,349 | 12/1965 | Bradley | 5/658 |
| 3,261,034 | 7/1966 | Bradley | 5/658 |
| 4,227,271 | 10/1980 | Kulka | 5/662 |
| 4,231,126 | 11/1980 | Hurkett | 5/503.1 |

FOREIGN PATENT DOCUMENTS

| | | | |
|---|---|---|---|
| 41121 | 3/1925 | Norway | 5/498 |

*Primary Examiner*—Flemming Saether
*Attorney, Agent, or Firm*—Peter D. Keefe

[57] ABSTRACT

An apparatus for preventing the development of bed sores, and once developed, successfully treating them, composed partly of an rigid elongate member which is transversely disposed across a hospital bed, wherein each end of the elongate member is engaged with a respective side rail of the hospital bed. The apparatus is further composed partly of a depression member which substantially vertically depends from the elongate member so as to depressably abut the mattress of the hospital bed. The depression member may be selectively located anywhere along the elongate member, and is preferably held abuttingly with respect to the elongate member by a frictional interface therebetween.

3 Claims, 2 Drawing Sheets

APPARATUS FOR TREATING AND PREVENTING DEVELOPMENT OF BED SORES

BACKGROUND OF THE INVENTION

1. Field of the Invention

The present invention relates to treatment and prevention of bed sores, and more particularly to an apparatus which effects to locally depress the patient's bed mattress so as to eliminate pressure upon an affected area of the patient's body.

2. Description of the Prior Art

When a patient is bed-ridden for an extended period of time, one of the unfortunate discomforts to be endured is the development of bed sores. Bed sores occur because of constant pressure of the bed mattress upon parts of the body which are not structured to endure such pressure, as are, for example the bottom of the feet. As a result of this pressure caused by the weight of the body at the contact location, circulation is adversely affected, eventually leading to a bed sore. Bed sores range in severity from painful skin areas to ulceration. Bed sores create great discomfort for the patient, and are a major source of concern to hospital personnel.

What is needed is some way to prevent the development of bed sores, and once developed, successfully treating them.

SUMMARY OF THE INVENTION

The present invention constitutes an apparatus for preventing the development of bed sores, and once developed, successfully treating them.

The apparatus according to the present invention is composed, in part, of a rigid elongate member which is transversely disposed across a hospital bed, wherein each end of the elongate member is engaged with a respective side rail of the hospital bed. The apparatus according to the present invention is further composed, in part, of a depression member which substantially vertically depends from the elongate member so as to depressably abut the mattress of the hospital bed. The depression member may be selectively located anywhere along the elongate member, and is preferably held abuttingly with respect to the elongate member by a frictional interface therebetween.

In operation, the care-giver determines whether a bed sore condition is impending or is occurring. If so, the care-giver then places the elongate member across the patient's hospital bed so that the ends of the elongate member engage the side rails of the hospital bed. The care-giver then places the depression member forceably between the mattress and the elongate member to thereby cause the mattress to be locally depressed in the area of the bed sore condition of the patient. The patient is now able to lie in comfort because the mattress is no longer pressuring the sore area of the patient. Blood circulation and air can now get into the affected area of the patient, and rapid healing can be expected in the absence of a more serious underlying condition.

Accordingly, it is an object of the present invention to provide an apparatus which treats existing bed sore conditions of a patient, and further prevents development of a bed sore when indications of an impending bed sore are noted in sufficient time by a care-giver.

It is a further object of the present invention to provide a treatment and preventative for bed sores, wherein the mattress of the patient's bed is locally depressed in the locale of the affected body part so as to promote healing by affording blood circulation and air thereat, It is another object of the present invention to provide a treatment and preventative for bed sores which is effective, inexpensive and easily administered.

These, and additional objects, advantages, features and benefits of the present invention will become apparent from the following specification.

DETAILED DESCRIPTION OF THE PREFERRED EMBODIMENT

Figure 1:
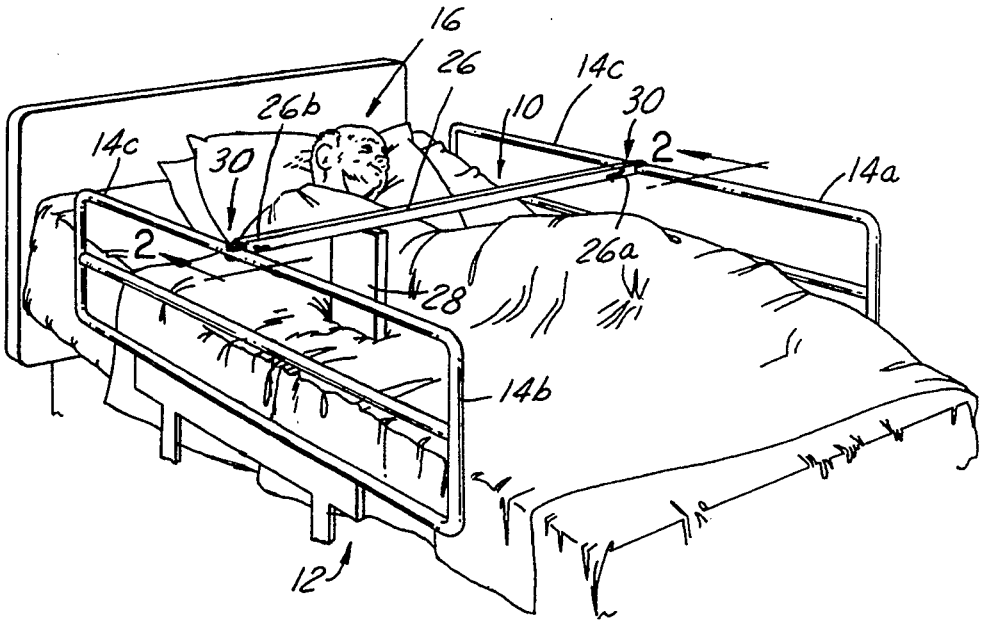
FIG. 1 is a perspective view of a patient bed-ridden in a hospital bed who is suffering from a bed sore, wherein the apparatus according to the present invention is shown in operation treating the the patient's bed sore.

Referring now to the Drawings, FIG. 1 shows the apparatus 10 according to the present invention being used in conjunction with a hospital bed 12. In this regard, the hospital bed 12 includes side rails **14*a*, 14*b* on either side of the hospital bed. Each of the side rails 14*a*, 14*b* include at least one longitudinally disposed bed rail 14*c*. FIG. 1 depicts a patient 16 who has the misfortune of being confined to the hospital bed 12 for a sufficiently long time that he has now developed a bed sore 18 (see FIG. 3) due to the continued pressure of the mattress 20 (see FIG. 2) of the hospital bed thereat pressuring against his body. FIG. 1 further depicts the apparatus 10 being used in conjunction with the hospital bed 12 to treat the bed sore 18 by causing local depression 22 (see FIG. 2) of the mattress 20 so that blood circulation and air can get to the affected area of the patient 16. As can still further be discerned from FIG. 1, the apparatus 10 is composed of a rigid elongate member 26 and a depression member 28. Referring now additionally to the remaining Figures, the structure and function of the apparatus 10** will be detailed with greater specificity.

Figure 3:
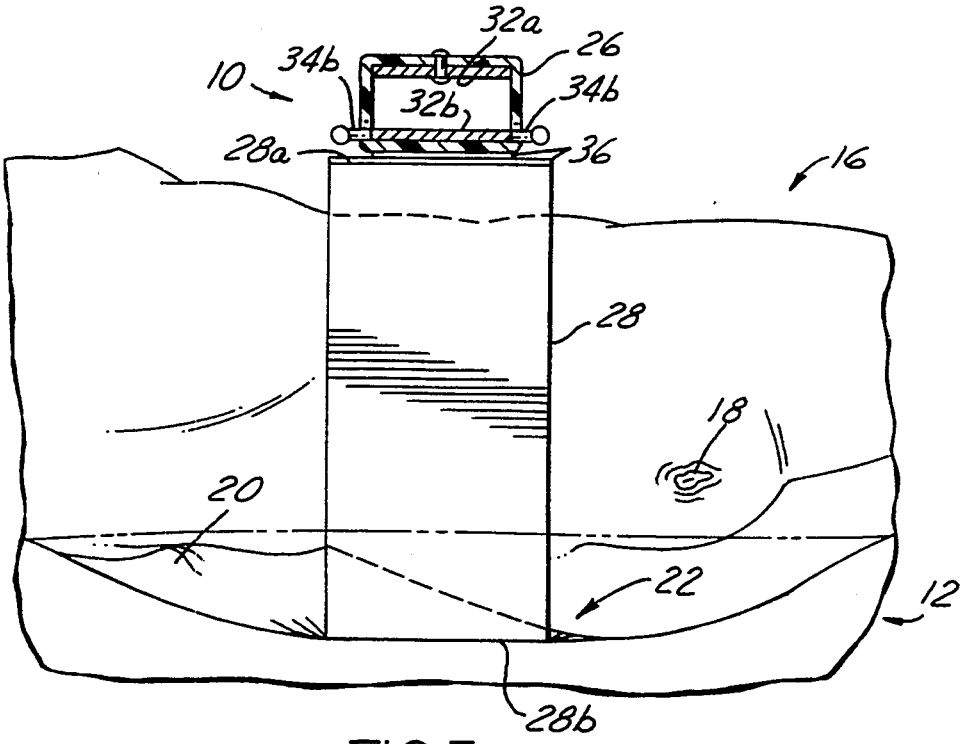
FIG. 3 is a partly sectional end view, seen along line 3—3 in FIG. 2.

The elongate member is dimensioned to transversely stretch between the side rails **14*a*, 14*b*. In its simplest form, each end 26*a*, 26*b* of the elongate member 26 simply engages the side rails 14*a*, 14*b* by abutting the bottom side of a rail 14*c* that is located above the mattress 20, preferably the uppermost rail, of the respective side rails, wherein the engagement is such as to prevent at least vertical movement of the elongate member with respect to the bed rails. However, it is preferred for each end of the elongate member to have a connection member 28 for engaging with the side rails 14*a*, 14*b* by interlocking with respect to the rail 14*c* thereof, as will be elaborated hereinbelow. A preferred material of construction is a lightweight, structurally rigid plastic, but other materials may be utilized. As shown in FIG. 3, the elongate member 26** may be of hollow construction so as to minimize weight and/or cost thereof.

Figure 2:
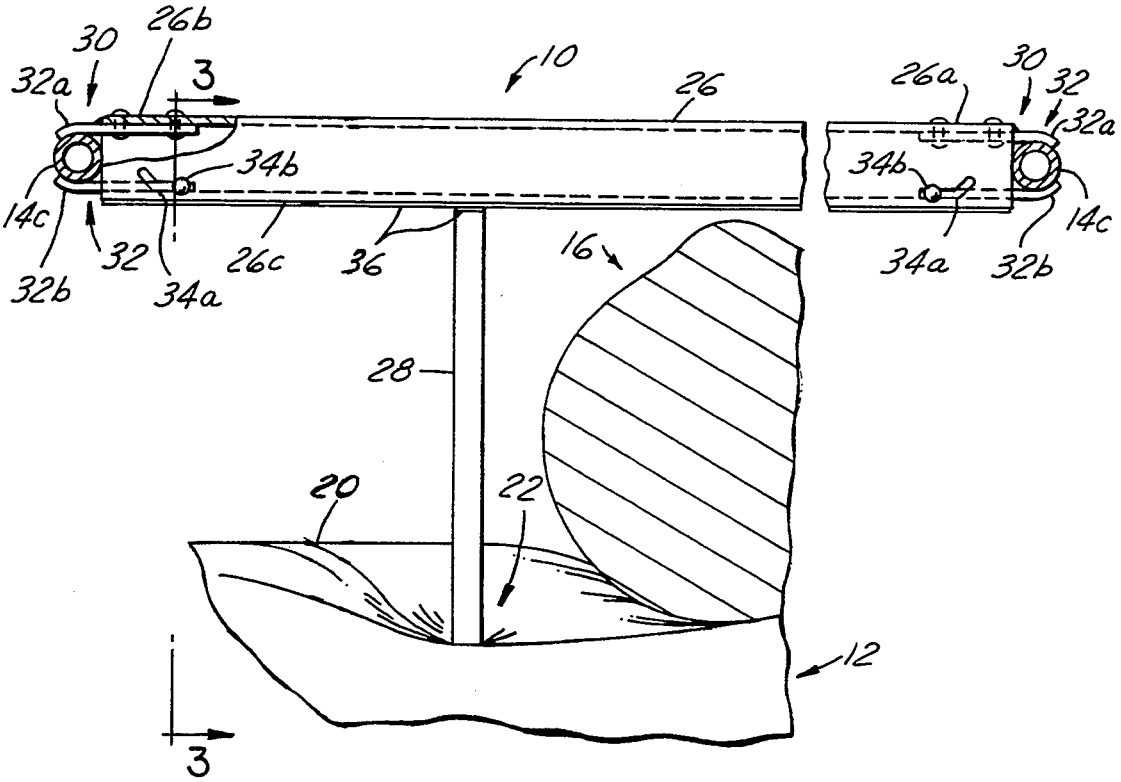
FIG. 2 is a partly broken away, partly sectional side view, seen along line 2—2 in FIG. 1, wherein the blanket is not shown in order to depict how the apparatus according to the present invention depresses the mattress locally adjacent to the patient.

The depression member 28 is dimensioned to abut the underside 26*c* of the elongate member 26 and then depressably abut the mattress 20 so as to form a depression area 22, as shown in FIGS. 2 and 3. The depression member 28 may be rectangular, round or of some other cross-section, and may or may not have provision for an increased surface area at either the top end 28*a* and/or the bottom end 28*b* thereof. Preferably, in operation the depression member 28 is oriented substantially vertically between the elongate member 26 and the mattress 20, although this is not a requirement so long as the depression member remains in abutment with the underside 26*c* of the elongate member.

Preferably, a frictional interface is provided between the top end 28*a* of the depression member 28 and the underside 26*c* of the elongate member 26. This may be accomplished, for instance, by providing an adhesively secured friction layer 36 at either the aforesaid underside 26*c*, the aforesaid top end 28*a*, or both. Other structural interrelationships may be provided as between the elongate member 26 and the depression member 28 so as to keep the top end 28*a* of the depression member from accidentally sliding off from its abutting relationship with the underside 26*c* of the elongate member.

Figure 4:
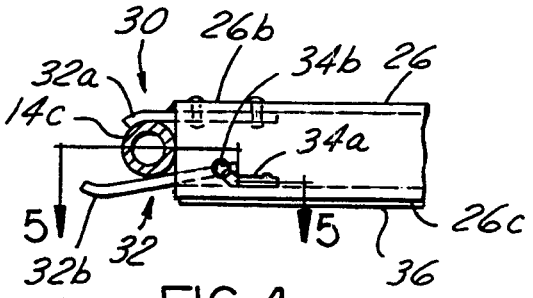
FIG. 4 is a detail, partly sectional side view of the bed rail connection member according to the present invention.
Figure 5:
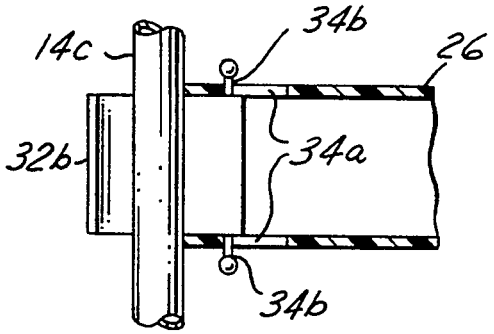
FIG. 5 is a detail, partly sectional top plan view of the connection member shown in FIG. 4.

As mentioned hereinabove, it is preferred for the elongate member 26 to be engaged with the side rails 14*a*, 14*b* by an interlocking relationship with the bed rails 14*c* thereof. In this regard, each end 26*a*, 26*b* of the elongate member is equipped with a connection member 30. A preferred connection member 30 is a swivel bracket 32. Each swivel bracket 32 is composed of a stationary finger 32*a* fixedly connected with the elongate member 26 and a movable finger 32*b* slidably connected with the elongate member. Each finger 32*a*, 32*b* is provided with a curved tip for mutually securably engaging a bed rail 14*c*. Each stationary finger 32*a* rests upon the top of its respective rail 14*c* and allows for the elongate member 26 to be slid therealong so as to aid in positioning the elongate member over the bed sore area of the patient. The movable finger 32*b* is regulated by opposing knobs 34*b*, wherein the knobs may be slid to a first position (see FIGS. 4 and 5) which results in the movable finger being slid into an open position, and wherein the knobs may be slid to a second position (see FIG. 2) which results in the movable finger being slid holdably into a closed position. In the open position, the bed rail 14*c* may be slipped between the stationary and movable fingers 32*a*, 32*b*. In the closed position, the movable finger 32*b* is clamped with respect to the stationary finger 32*a* so as to interlock the elongate member 26 clampably with the bed rail 14*c*. It is preferred to have a clamping engagement of the elongate member 26 with the bed rails 14*c* so that the elongate member cannot accidentally slip along the bed rails when the apparatus 10 is in operation. Of course, either of the fingers may be the movable finger. Further, the swivel bracket 32 described herein is only by way of example, and other connection member mechanisms may be utilized.

In operation, the care-giver makes a determination whether a bed sore condition is impending or is occurring with respect to the patient 16. If so, the care-giver then places the elongate member 26 across the patient's hospital bed 12 so that the ends 26*a*, 26*b* of the elongate member engage the side rails 14*a*, 14*b* of the hospital bed. The care giver selects a position of the elongate member 26 so that it substantially passes above the affected area of the patient. Preferably in this regard, the elongate member 26 is clampably engaged with respect to the rails 14*c* via connection members 30. The care-giver then places the depression member 28 forceably between the mattress 20 (there being usually blankets, sheets etc. atop the mattress) and the elongate member 26 to thereby cause the mattress to be locally depressed in the area of the bed sore condition of the patient. The patient is now able to lie in comfort because the mattress is no longer pressuring the area of the bed sore 18 of the patient, Blood circulation and air can now get into the affected area of the patient, and rapid healing can be expected in the absence of a more serious underlying condition.

As the patient may shift his or her position, the apparatus 10 may be adjusted as outlined above. Further, some patients may benefit from a plurality of apparatus 10 being in operation simultaneously to relieve multiple bed sore affections. And, of course, more than one depression member 28 can be used with each elongate member 26.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. An apparatus for treating bed sore conditions of a patient confined to a hospital bed, wherein the hospital bed has a mattress, wherein further the hospital bed has a side rail elevated above the mattress at each side thereof for the purpose of preventing a patient from accidentally rolling out of the bed, said apparatus comprising:

an elongate member composed of a rigid material, said elongate member being straight along its entire length, said elongate member having a first end and an opposite second end, wherein each of said first and second ends directly engage, respectively, with the side rails of the hospital bed to thereby locate the elongate member above the mattress of the bed at an elevation defined by the elevation of the side rails, wherein the engagement of the elongate member with the side rails at least prevents said elongate member from moving vertically away from the mattress of the hospital bed, said elongate member having an underside facing toward the mattress of the hospital bed; and at least one depression member having a top end and an opposite bottom end, said top end of said depression member being abuttingly engaged at a selected location of said underside of said elongate member, said depression member being structured so that said bottom end thereof depresses the mattress of the hospital bed when the top end thereof is abuttingly engaged with said underside of said elongate member.

2. The apparatus of claim 1, further comprising interfacing means for preventing said top end of said depression member from slipping off of said underside of said elongate member.

3. The apparatus of claim 2, further comprising connection member means for clampably engaging each of said first and second ends of said elongate member, respectively, to the side rails of the hospital bed.

* * * * *